US006523581B2

(12) United States Patent
Pendleton et al.

(10) Patent No.: US 6,523,581 B2
(45) Date of Patent: Feb. 25, 2003

(54) APPARATUS AND METHOD FOR MINIMIZING VAPOR LOSS

(75) Inventors: David R. Pendleton, Fairfield, OH (US); James E. Kesterman, Cincinnati, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/874,864

(22) Filed: Jun. 5, 2001

(65) Prior Publication Data

US 2002/0179178 A1 Dec. 5, 2002

(51) Int. Cl.[7] ..... B65B 1/04
(52) U.S. Cl. ..... 141/86; 141/311 A; 220/571
(58) Field of Search ..... 141/311 A, 86–88; 220/571; 405/52, 53, 128, 129

(56) References Cited

U.S. PATENT DOCUMENTS 4,793,387 A * 12/1988 LeBlanc et al. ..... 137/312
5,117,877 A * 6/1992 Sharp ..... 137/371
5,865,222 A * 2/1999 Diamond ..... 114/343
6,267,156 B1 * 7/2001 Argandona ..... 141/86

OTHER PUBLICATIONS

OPW Fueling Components: Catalog—Service Station Products; 2 pages; 1997.

OPW Instructions—Assembly and Installation Instructions for OPW 61–SO and 61–SOM Carb Required Overfill Prevention Valves; pp. 1–11, Jan. 1993.

* cited by examiner

*Primary Examiner*—Steven O Douglas
(74) *Attorney, Agent, or Firm*—Dinsmore & Shohl LLP

(57) ABSTRACT

A fuel fluid communication assembly cooperates with a reservoir configured to contain fuel fluids, and includes a spill restrictor that may act as a secondary containment system and which is configured to restrict leakage to the environment of any liquid fuel present in the interior of the spill restrictor. The fuel fluid communication assembly has a first hollow body with an inwardly facing surface, a restrictor end and a reservoir end. The fuel fluid communication assembly may also have a second hollow body having an outwardly facing surface. The second hollow body is received telescopingly within at least the reservoir end of the first hollow body. The inwardly facing surface of the first hollow body and the outwardly facing surface of the second hollow body define an interstitial space. The fuel fluid communication assembly further has an interstitial space seal.

41 Claims, 10 Drawing Sheets

APPARATUS AND METHOD FOR MINIMIZING VAPOR LOSS

TECHNICAL FIELD

The present invention relates generally to fuel systems, and more specifically to an apparatus and a method for minimizing vapor loss from a fuel reservoir while providing an option for spill containment.

BACKGROUND OF THE INVENTION

Our increasingly mobile and mechanized society uses a variety of different fuels (e.g., gasoline, diesel fuel, ethanol, etc.) as energy. Liquid fuels are generally stored in reservoirs such as underground storage tanks, above ground tanks, or any of a variety of different containers. Typically, liquid fuel reservoirs have inlets and outlets through which fuel can be added to and/or removed from the reservoir. These inlets and outlets may typically consist of a riser pipe extending from the reservoir. Internal to the riser pipe is a drop tube and the space between the riser pipe and the drop tube is called the interstitial space. The riser pipe is typically threaded to an adapter collar to which a fuel line can be coupled. A spill container surrounds the fill adaptor collar and acts as a secondary containment system for any overflow or spillage that may occur during the filling process.

Such configurations have proven to be very effective, however, the interstitial space between the riser pipe and the drop tube can allow an excessive amount of vapor to be introduced into the atmosphere, especially during the filling process. For example, the interstitial space can act as a chimney for vapor to be released from the ullage of the tank. Though the interstitial space area is relatively small, because of this chimney effect, the vapor from the entire ullage area of the reservoir can be released through the interstitial space. Therefore, there is a need for an apparatus and a method for minimizing vapor loss from a fuel reservoir while providing for secondary containment during filling and drainage procedures.

SUMMARY OF THE INVENTION

A fuel fluid communication assembly cooperates with a reservoir configured to contain fuel fluids. The fuel fluid communication assembly includes a spill restrictor that may act as a secondary containment system and which is configured to restrict leakage to the environment of any liquid fuel present in the interior of the spill restrictor. The fuel fluid communication assembly also has a first hollow body with an inwardly facing surface, a restrictor end and a reservoir end. The fuel fluid communication assembly also has a second hollow body having an outwardly facing surface. The second hollow body is received telescopingly within at least the reservoir end of the first hollow body. The inwardly facing surface of the first hollow body and the outwardly facing surface of the second hollow body define an interstitial space. The fuel fluid communication assembly further has an interstitial space seal.

Certain embodiments of the fuel fluid communication assembly may also have a flange that is in cooperation with the first and second hollow bodies. The flange can be capable of substantially sealing the interstitial space with respect to the spill restrictor. The fuel fluid communication assembly also may have a third hollow body that is at least partially disposed in the interior space of the spill restrictor. Such a third hollow body would also be in fluid communication with the second hollow body. The fuel fluid communication assembly also may have a biasing device disposed between the third hollow body and the second hollow body. The biasing device can be configured to provide a sealing force to the flange. The sealing force can be used to help substantially seal the interstitial space with respect to the spill restrictor.

Advantages and novel features of the present invention will become apparent to those skilled in the art from the following detailed description, which simply illustrates various modes and examples contemplated for carrying out the invention. As will be realized, the invention is capable of other different aspects, all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention, it is believed that the same will be better understood from the following description, taken in conjunction with the accompanying drawings, in which:

DETAILED DESCRIPTION OF EXEMPLARY EMBODIMENTS

Reference will now be made in detail to various exemplary embodiments of the invention, several of which are also illustrated in the accompanying drawings, wherein like numerals indicate the same elements throughout the views and the same last two digits represents similar elements in different embodiments.

Figure 1:
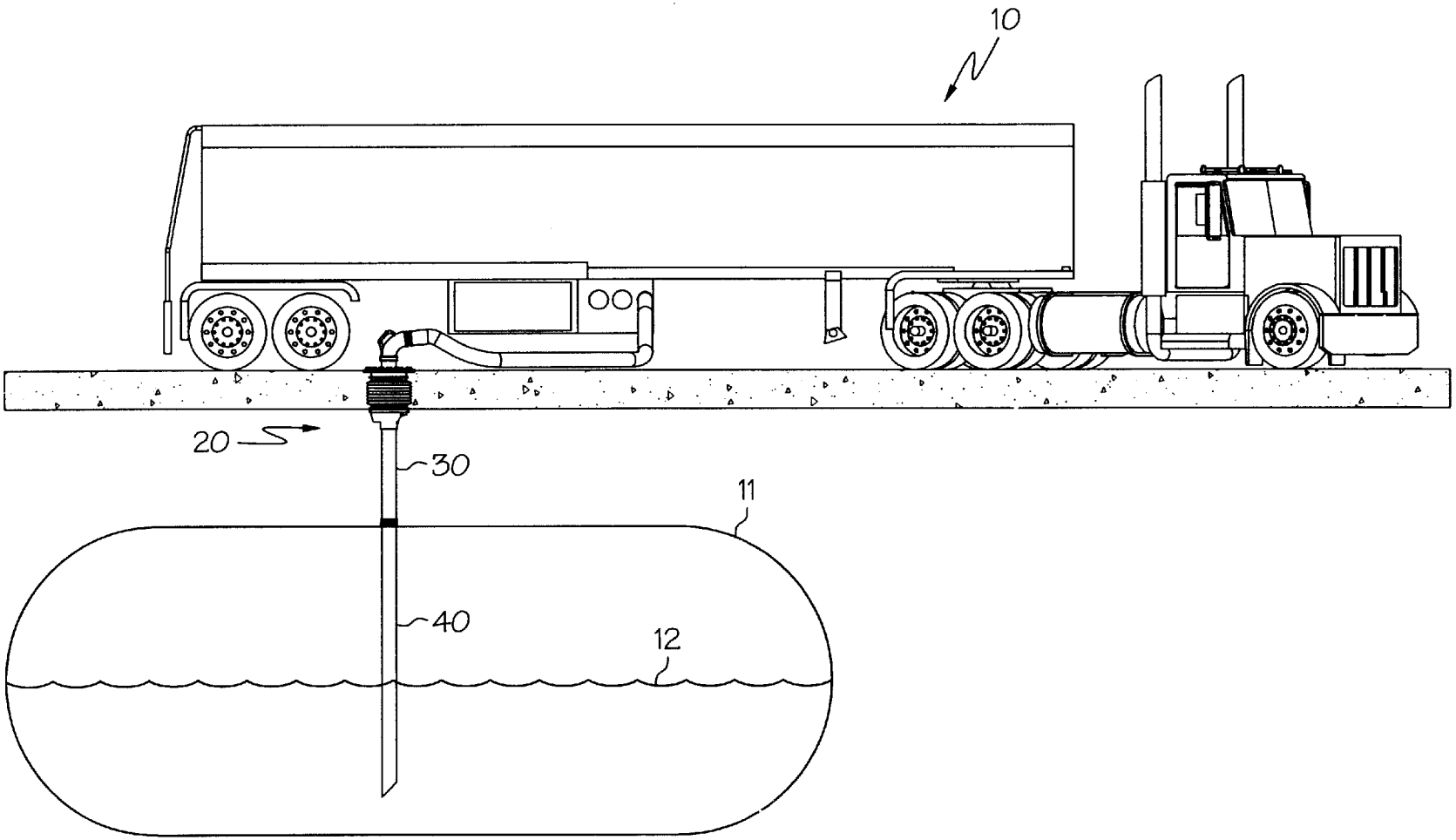
FIG. 1 (PRIOR ART)
FIG. 1 is an schematic view of a prior art installation of an embodiment of a fuel fluid communication assembly, as illustrated with a fuel delivery trick and a tank.

FIG. 1 depicts a tank 11 partially filled with fuel fluid 12, a fuel truck 10, and a conventional fuel fluid communication assembly 20. In certain embodiments, the tank 11 might contain a liquid hydrocarbon fuel such as gasoline, diesel fuel, ethanol, etc., or other chemicals, and may be either completely or partially above or below ground. The tank 11 can be filled with product by, for example, opening a lid (shown a as 26 in FIG. 3) and transferring the product from the truck 10 to the tank 11. A pump can then be utilized to transfer the product from the tank 11 to product dispensers (not shown), which may be conventional service station gas pumps. The fuel fluid communication assembly 20 has a riser pipe 30 in communication with the tank 11 and has a drop tube 40 that is at least partially disposed within the riser 30.

Figure 2:
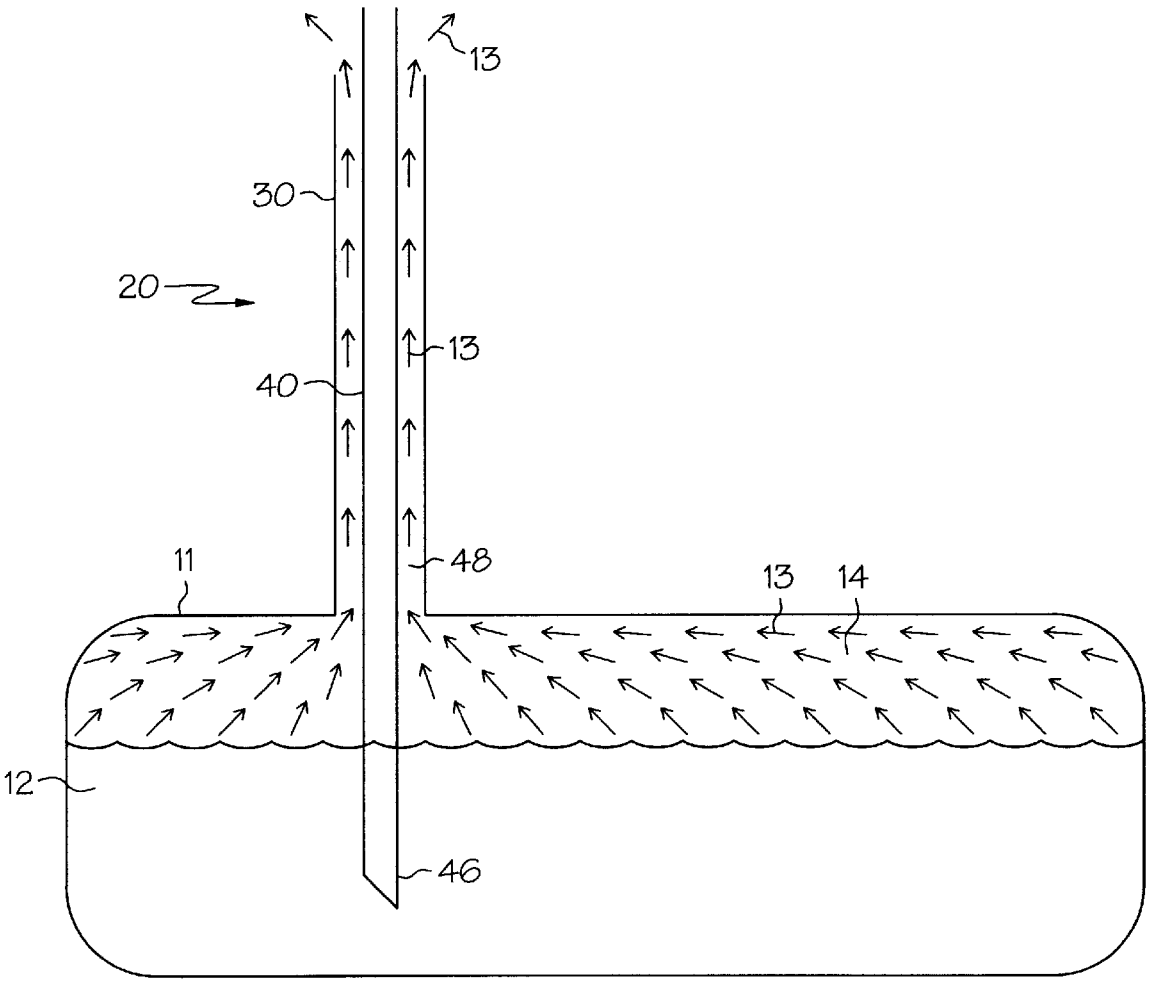
FIG. 2 (PRIOR ART)
FIG. 2 is a partial schematic view of the lower portion of an embodiment of the fuel fluid communication assembly, as illustrated with a tank, from FIG. 1.

FIG. 2 depicts a lower portion of an embodiment of the fuel fluid communication assembly and the tank 11 illustrated in FIG. 1. The depicted portion of drop tube 40 has a smaller outer dimension than the inner dimension of the depicted portion of riser pipe 30. This difference in size between the riser pipe 30 and the drop tube 40 defines an interstitial space 48.

The fuel fluid 12 provides a source of vapor 13. The vapor 13 may form in the ullage 14 above the level of fuel fluid 12. As pressure increases within the tank 11, the vapor 13 begins to flow along the path of least resistance. In the depicted embodiment, the path of least resistance is up through the interstitial space 48 and out into the atmosphere or, in this case, into the upper portion of the assembly (See also FIG. 1).

In the depicted assembly 20, the reservoir end 46 of the drop tube 40 is submerged. One potential advantage of such an embodiment could be that it keeps vapor 13 at the surface of the fuel fluid 12 from escaping up the interior of the drop tube 40. Although some of the vapor 13 from the fluid within the drop tube 40 could escape up the interior of the drop tube 40, this area is small in comparison to the entire ullage 14 in the tank 11, and any such vapor escape is comparatively small and may be allowed by air quality standards.

Figure 3:
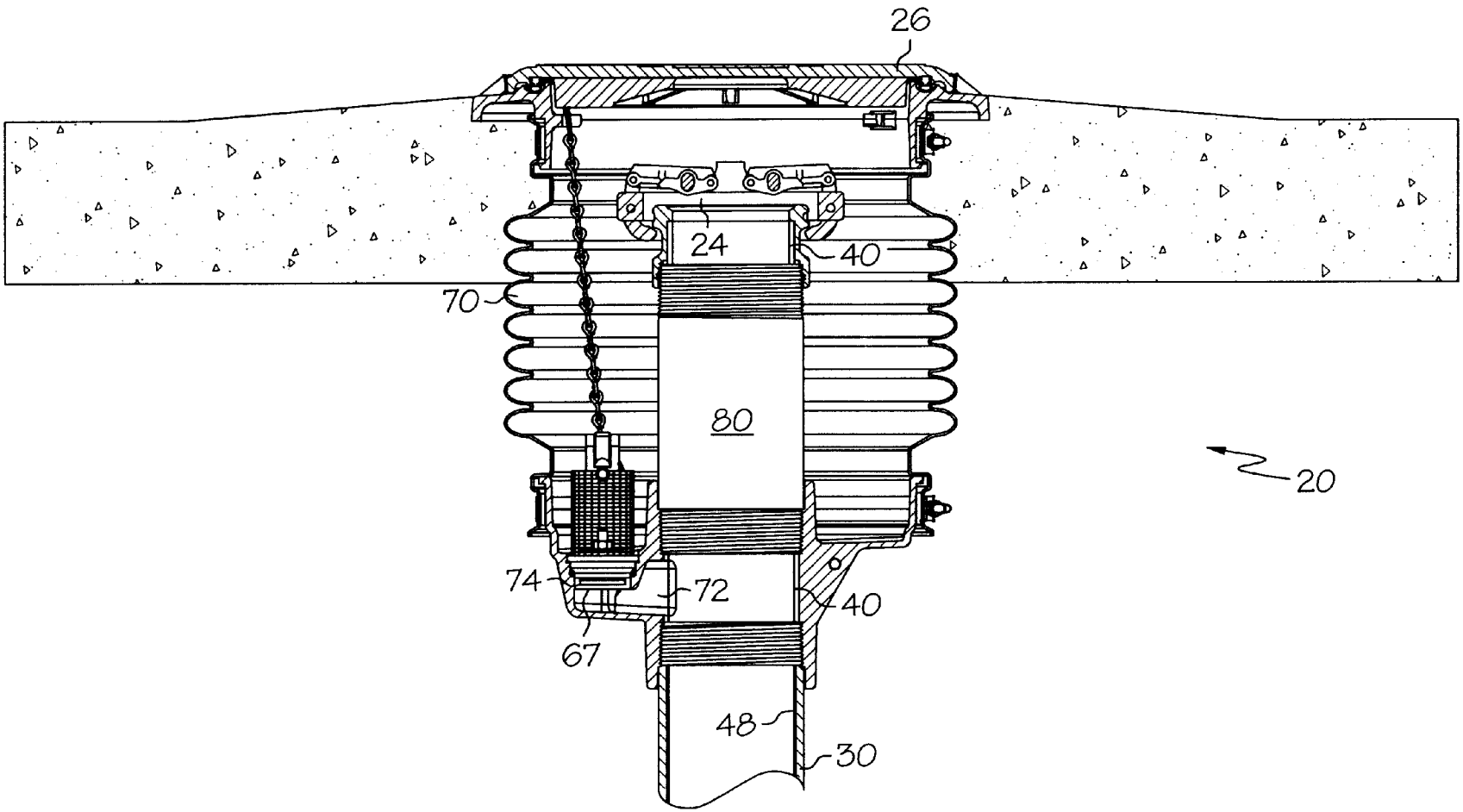
FIG. 3 (PRIOR ART)
FIG. 3 is a partial cross sectional view of the upper portion of an embodiment of the fuel fluid communication assembly from FIG. 1.

FIG. 3 shows the detail of an upper portion of an embodiment of a fuel fluid communication assembly such as that illustrated in FIG. 1. In a conventional assembly 20, the drop tube 40 extends from within the tank 11 to beyond a pipe nipple 80 just below a cap 24. In addition to an interstitial space 48 between the riser pipe 30 and the drop tube 40, another interstitial space (not shown) may exist between the pipe nipple 80 and the drop tube 40, which may or may not be sealed. However, the interstitial space 48 between the riser 30 and the drop tube 40 is not sealed. When a drain valve 74 is opened, an overflow sump 72 selectively and purposefully drains back into the interstitial space 48 to remove fuel fluid 12 from a spill container 70. This also allows vapor from the fuel fluid 12 in the tank 11 to pass through the interstitial space 48, into the overflow sump 72, and then into the spill container 70. A significant problem in the industry exists where, for example, because the systems are in such a harsh environment, the drain valve 74 is often found in a slightly open position. (For example, due to wear, debris lodged between the drain valve 74 and an entry end 67 of the sump 72, or inadvertence in placement.) Whether the drain valve 74 is intentionally opened or stuck open, vapor 13 from the ullage 14 may fill the spill container 70. Thus, at least while the lid 26 is open, vapor is allowed to escape into the atmosphere.

FIGS. 4–8 (not including 6A) depict partial views of one embodiment of a fuel fluid communication assembly 120, made in accordance with the present invention, as it might appear in use. The depicted embodiment is of a fuel fluid communication assembly for adding or removing fuel fluid between a fuel truck and a fuel reservoir. The assembly has a spill restrictor, a first hollow body, a second hollow body, an interstitial space, and an interstitial space seal.

Figure 4:
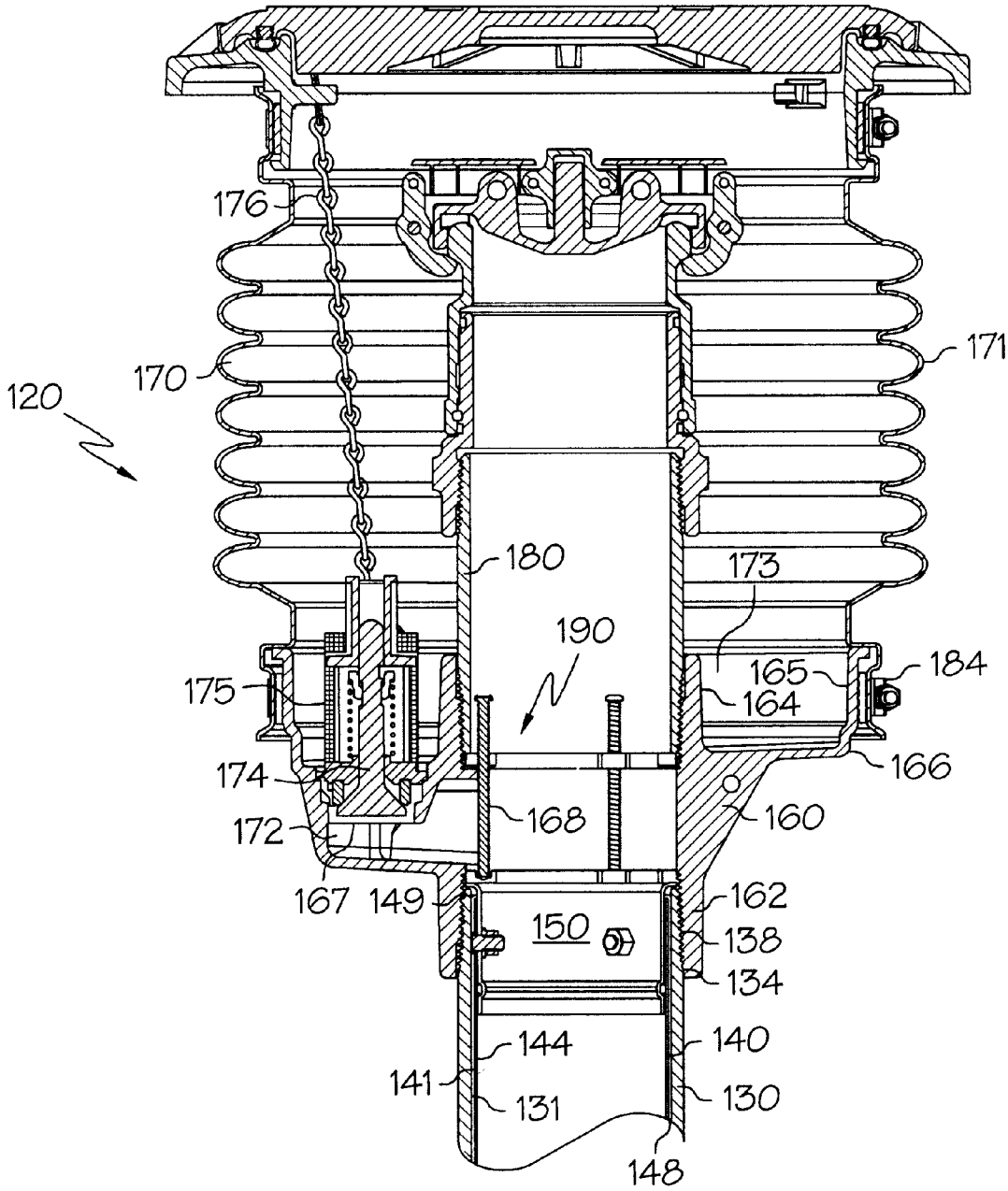
FIG. 4 is a partial cross sectional view of the upper portion of an exemplary embodiment of a fuel fluid communication assembly made in accordance with the present invention.

Referring to FIG. 4, extending upward from the reservoir (not shown) is a first hollow body, such as riser 130 (only partially depicted). The riser 130 attaches to the spill restrictor, such as a spill container 170, and has an inwardly facing surface 131 (See also FIG. 6). The riser 130 has a reservoir end (not shown) proximate to the reservoir and a restrictor end 138 proximate to the spill container 170. In other embodiments made in accordance with the present invention, other configurations of a first hollow body may extend in various arrangements from the reservoir or may be connected to another piping assembly or device.

The fuel fluid communication assembly 120 has a second hollow body, such as a drop tube 140 (also only partially depicted). The drop tube 140 has an outwardly facing surface 141 and an inwardly facing surface 144 (See also FIG. 6). The drop tube 140 is received telescopingly within at least the reservoir end (not shown) of the riser 130. For example, the drop tube 140 is at least partially disposed within the riser 130 and extends into the reservoir.

The inwardly facing surface 131 of the riser 130 and the outwardly facing surface 141 of the drop tube 140 define an interstitial space 148, or otherwise stated, the interstitial space 148 can be the space between the riser 130 and the drop tube 140. The interstitial space 148 has a restrictor end 149 (See also FIG. 6) distal from the reservoir. An interstitial space seal, such as first and second seal members 156 and 158, is located adjacent to the restrictor end 149.

An exemplary drop tube 140 penetrates the interior of a reservoir (such as an underground storage tank 11 of FIG. 1) and may extend at its one end to the bottom of the reservoir. As previously discussed, one advantage of submerging the drop tube 140 in the fluid includes minimizing vapor emissions. Typically, the outer diameter of the drop tube 140 will be slightly less than the inner diameter of the riser 130. For example, the inner diameter of the riser may be 3.75 inches (95.2 mm), while the outer diameter may be 3.875 inches (98.4 mm millimeters).

In the depicted exemplary embodiment of FIG. 4, the restrictor end 138 of the riser 130 is configured to cooperate with spill container 170. For example, the outwardly facing surface 134 at the riser's restrictor end 138 can be correspondingly threaded to interface with mating threads on the spill container 170. More particularly, as shown in the exemplary embodiment, the spill container 170 may have a riser adaptor 160. The riser adaptor 160 might include a threaded inner surface at an end (e.g., reservoir end 162) of the riser adaptor 160 for connection with the riser's restrictor end 138.

Meanwhile, a third hollow body may be connected (e.g., seallingly connected) to the adaptor's restrictor end 164. An opposite or restrictor end 164 of the riser adaptor 160 may also be threaded at an inner surface. The third hollow body may be a pipe nipple, a tee, or any other configuration as known to those skilled in the art. In the depicted embodiment, the third hollow body is a pipe nipple 180. In one embodiment, threaded connections such as these discussed above may be made using a material, such as pipe tape or pipe sealant, to aid in sealing the connection, protecting the threads from corrosion, making the pipes liquid and vapor tight, and making the pipes easier to disassemble in the future. In alternative embodiments, other methods of attachment may be used as would be obvious to one skilled in the art.

Riser adapter 160 can function as a base for spill container 170, wherein a shell 171 can be attached to the riser adaptor 160, such as by a clamp 184, to form the spill container 170. In an exemplary embodiment, an outer portion of the adaptor's restrictor end 164 may have a channel 165 that can define an annular trough 166 surrounding the pipe nipple 180.

Figure 5:
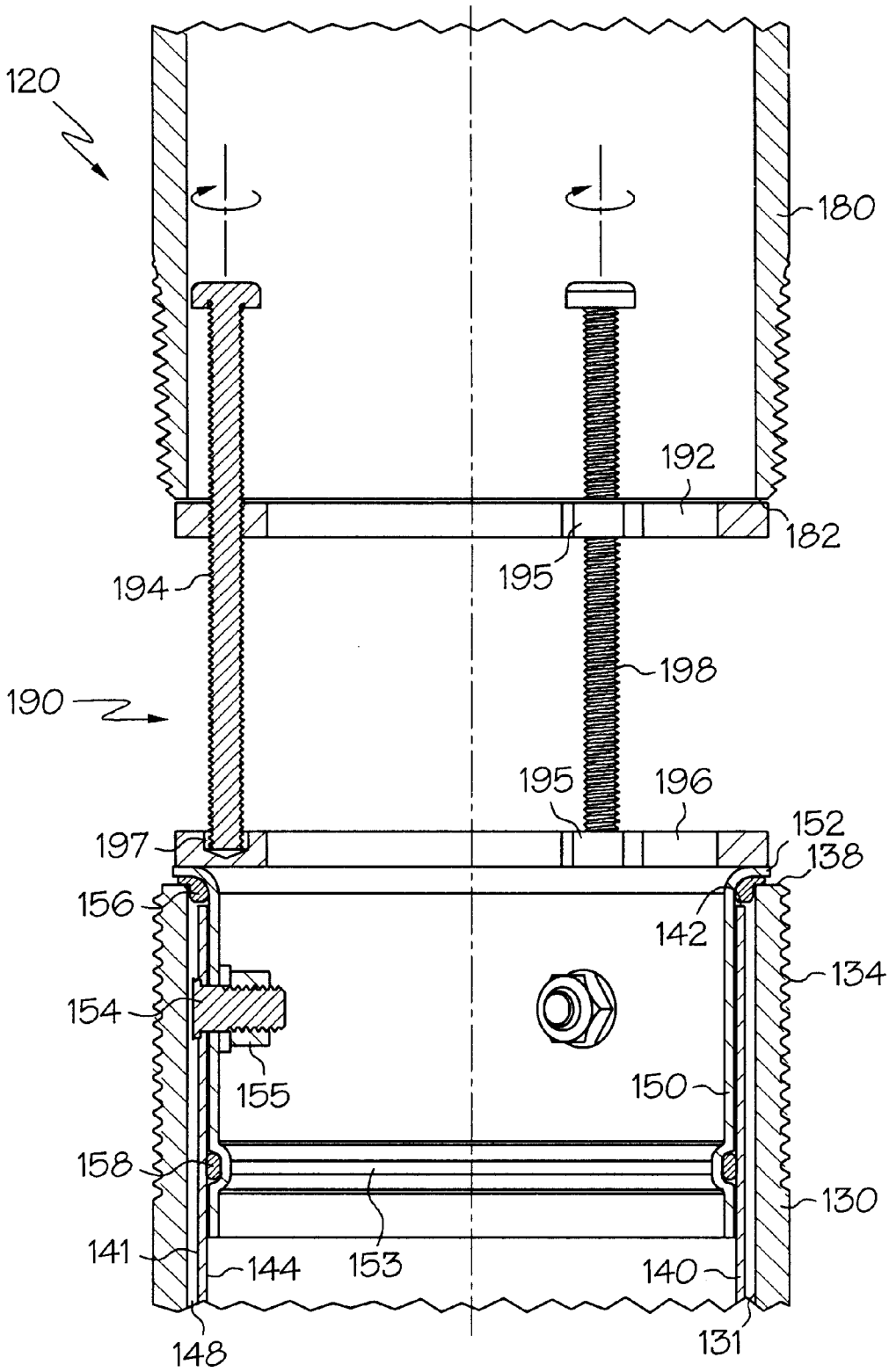
FIG. 5 is an enlarged, partial cross sectional view of the assembly embodiment depicted in FIG. 4.

Referring to FIG. 5, in this embodiment of the fuel fluid communication assembly 120, a flange (such as flange 152) can be disposed adjacent to the restrictor end 138 of the riser 130 or restrictor end 142 of drop tube 140. In one embodiment, flange 152 could be welded, rolled, or otherwise affixed to a restrictor end 142 of drop tube 140.

For example, and as shown, flange 152 can be, or is part of, a nozzle 150. Nozzle 150 is attached to drop tube 140, such as by a bolt 154 and a nut 155. In the illustrated embodiment, flange 152 comprises a portion of nozzle 150 that is bent to extend radially outwardly from the nozzle 150. In such an embodiment, at the flange 152, the nozzle 150 can be separated from the restrictor end 138 of the riser130 by a first sealing member 156, and, the nozzle 150 can be separated from the restrictor end 142 of the drop tube 140 by a second sealing member 158.

Figure 6:
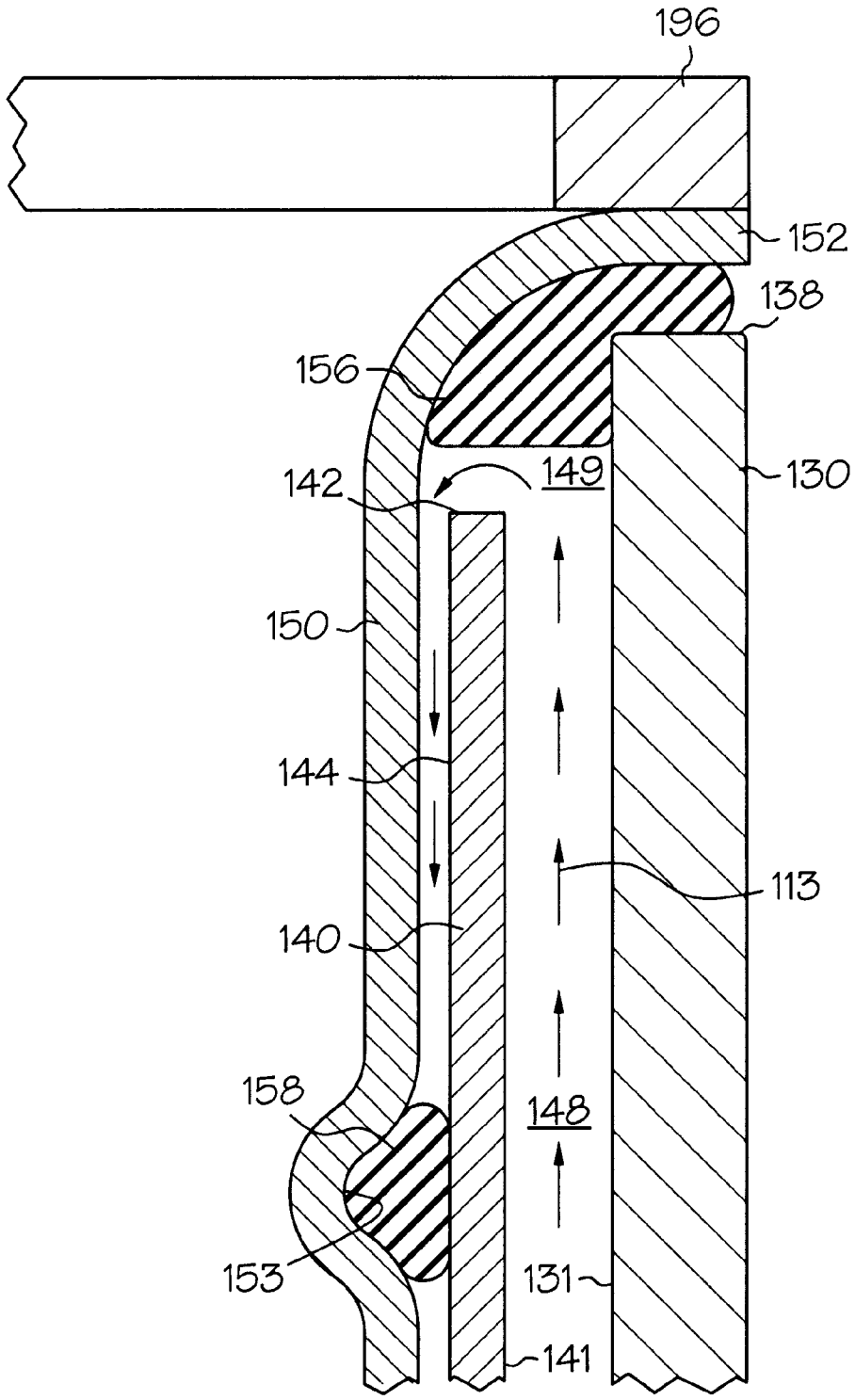
FIG. 6 is a further enlarged, partial cross sectional view of the assembly of FIG. 5.

Referring to FIG. 6, one advantage of using a flange such as flange 152 could include working in cooperation with the interstitial space seal to substantially seal the interstitial space 148 between the drop tube 140 and the riser 130. For example, the interstitial space seal may comprise the above mentioned first and second seal members, 156, 158 respectively. In such an embodiment, first seal member 156 could be located at the riser's restrictor end 138 and used to seal between riser 130 and flange 152. In an exemplary embodiment including nozzle 150, channel 153 can be located radially about an outer perimeter of the nozzle 150 and spaced from flange 152. Second seal member 158 can be used to seal between an inner surface 144 of the drop tube 140 and the channel 153.

In the illustrated embodiment, the riser's restrictor end 138 extends slightly beyond the drop tube's restrictor end 142. For example, drop tube's restrictor end 142 is held at a height between the riser's restrictor end 138 and the channel 153. This configuration, along with the combination of the first seal member 156 and the second seal member 158, can allow for a substantial seal of any vapor 113 (depicted as arrows) within the interstitial space 148. A seal such as those comprising first seal member 156 and second seal member 158, may be made from, among other materials, rubber materials such as flourosilicone, flouroelastomer, nitrile or silicone, for example. Suitable materials might include those that exhibit good resistance to fuel attack while also maintaining good rebound characteristics for sealing. Other materials, as would be known to those skilled in the art, may be appropriate.

Figure 6A:
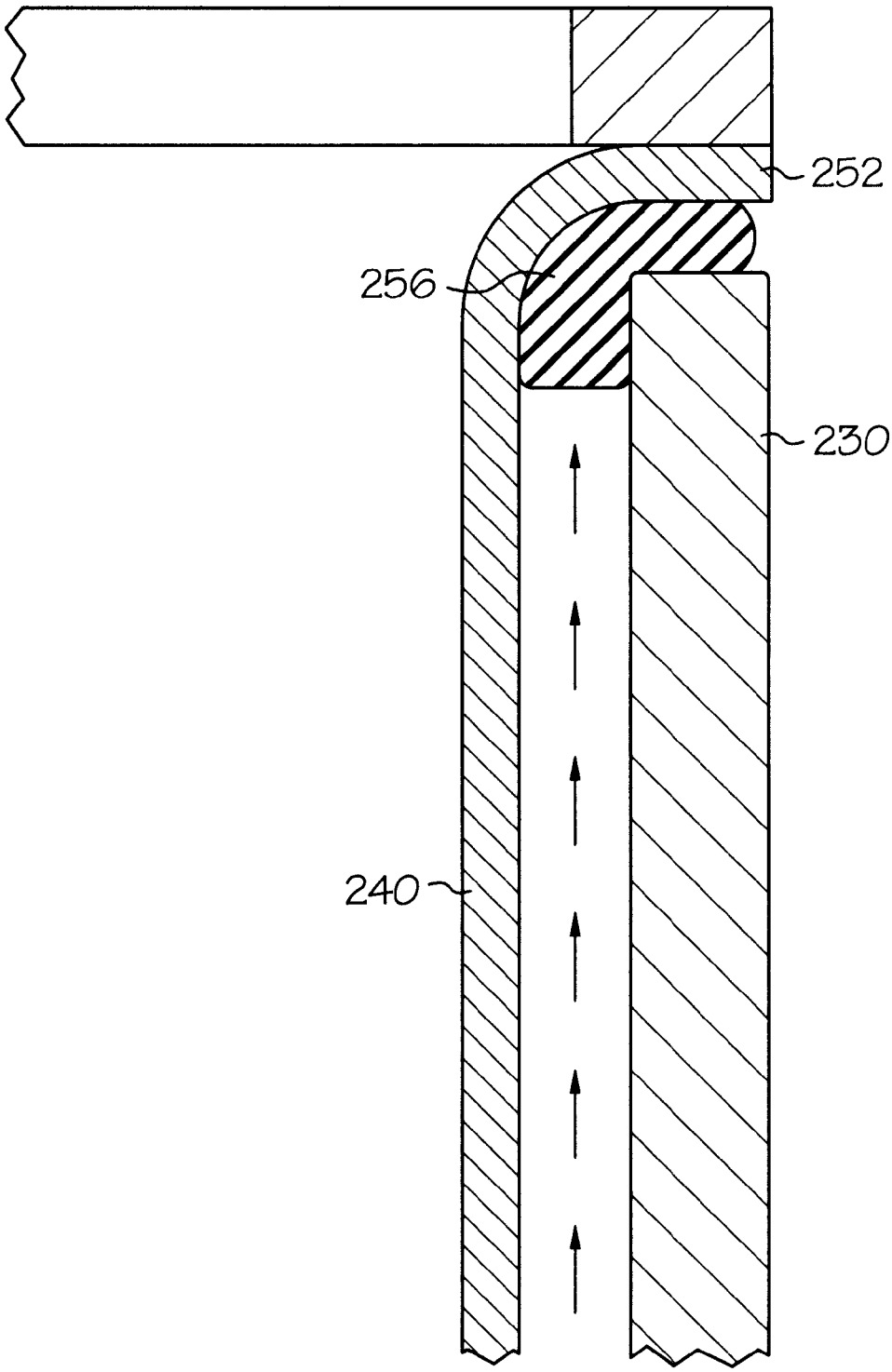
FIG. 6A is a enlarged, partial cross sectional view of an exemplary embodiment of a fuel fluid communication assembly made in accordance with the present invention.

FIG. 6A depicts an alternative to the embodiment shown in FIG. 6, wherein the flange 252 is rolled, welded, or otherwise formed as part of the drop tube 240. This embodiment eliminates the need for the second seal member. As will be understood, the first sealing member 256 can be inserted between the riser 230 and the drop tube 240 at the drop tube's flange 252.

In other embodiments according to the present invention, for example, a spill restrictor may be configured as a variety of devices such as an outer pipe, a sump, a restrictor plate or a container. Referring back to FIG. 4, and as in the exemplary embodiment discussed herein, the spill restrictor is shown as a spill container 170. The shell 171 of spill container 170, for example, may comprise an accordion type plastic or metal container.

As an example, the structure of spill container 170 can provide an alternative or auxiliary fuel fluid pathway when filling a reservoir. When a transport drop is being made, overflow or spillage may occur at the interface between a transport fill nozzle (not shown) and the fuel fluid communication assembly 120. An interior space 173 of spill container 170 could act as a collector and/or funnel arrangement to return the spilled fuel to a reservoir.

Figure 7:
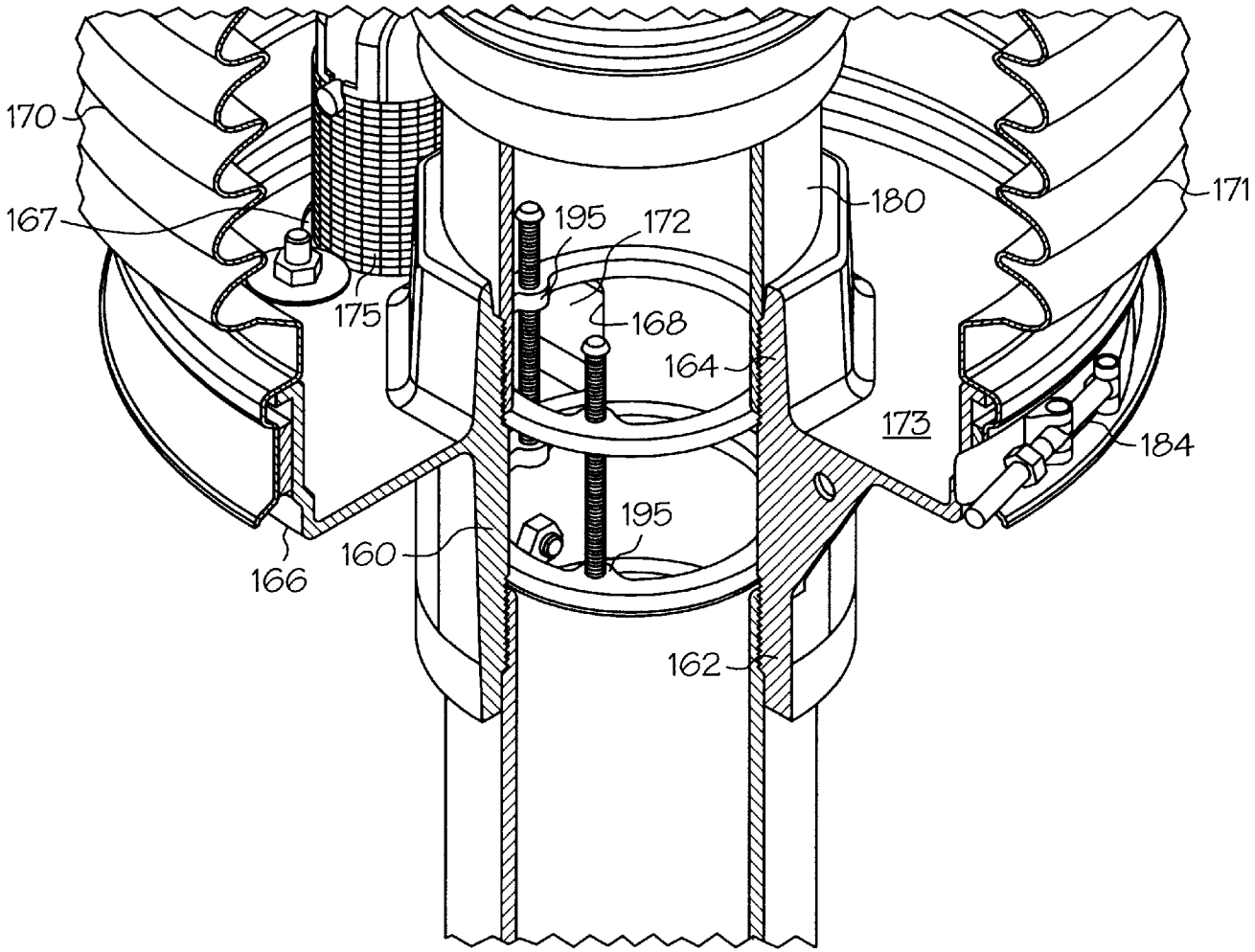
FIG. 7 is a partial broken out perspective view of the fuel fluid communication assembly depicted in FIG. 4.

According to such an exemplary embodiment and referring now to FIG. 7, interior space 173 of the exemplary spill container 170 may be defined by the trough 166 of riser adaptor 160 as the bottom border of the interior space 173, and the spill container's shell 171 as an outer wall. At least a portion of the pipe nipple 180 may be located within the interior space 173. According to one embodiment, interior space 173 of spill container 170 can be in communication with overflow sump 172. (See also FIG. 4.) Overflow sump 172 may comprise, for example, a channel or a drain opening through riser adapter 160. In an exemplary embodiment, overflow sump 172 extends from an entry end 167 at trough 166 to an exit end 168. In one embodiment, exit end 168 can be located between the reservoir end 162 and the restrictor end 164 of the riser adaptor 160.

As seen in FIG. 4, the fluid communication assembly 120 can also include a drain valve 174, such as for example, adjacent the sump entry end 167, and can be configured to selectively provide fluid communication between the interior space 173 of the spill container 170 and overflow sump 172 (See FIG. 7). The drain valve 174 can be covered by a mesh 175, such as of wire or resistant plastic, that may help keep debris out of the drain valve 174. In one embodiment, drain valve 174 is recessed into trough 166 in order to seal between the interior space 173 of spill container 170 and the overflow sump 172.

In operation, a chain 176 can be pulled to open the drain valve 174 and drain the interior space 173 of spill container 170 into the overflow sump 172. From the overflow sump 172 any collected fuel can flow through the nozzle 150, and on through the drop tube 140 to the reservoir. As understood, without the previously described embodiment of the present invention, fluid such as vapors could leak out of the interstitial space 148. For example, as the flow of fluid during a filling operation may create a venturi causing vapor to be drawn from the tank, the vapor might otherwise have been drawn through the interstitial space 148 and released to the atmosphere. Also, if there is a poor seal at the drain valve, vapor can escape without the valve being opened. As the tank is pressurized, vapor may be forced out at the poor seal.

Referring again to FIG. 5, the depicted exemplary embodiment can also include a biasing device 190 configured to provide a sealing force capable of substantially sealing the interstitial space 148 with respect to the interior space 173 of a spill container (e.g. 170 in FIG. 4). The biasing device 190 might, as shown in this example, have a first member 192 adapted to engage, for example, the pipe nipple 180. The biasing device can also have a second member 196 that is adapted to engage, for example, the nozzle 150, and at least one biasing member, such as one or more adjustable screws 198 disposed between the first and second members, 192 and 196.

In the depicted embodiment, the exemplary biasing device 190 has a first member 192 adapted to engage a reservoir end 182 of the pipe nipple 180. The first member 192 can be annular in shape and have, for example, three threaded bores 194 substantially equally spaced along its perimeter. A half circle bulge or tab 195 (also shown in FIG. 7) can be used to extend into an interior of the first member 192 if needed to facilitate a proper size and minimize the interference of the biasing device with fluid flow, as will be further discussed herein.

In the illustrated embodiment, the first member 192 is "fixed" in the sense that its position is determined by the position of the third hollow body (e.g., pipe nipple 180). The location of the third hollow body may be dictated, for example, by the position and threads of the riser adaptor 160. This may be particularly the case when adapting or retrofitting an existing fuel fluid communication assembly. The third hollow body will typically be made of metal and therefore of negligible flex or give in comparison to any seals adjacent to the second member 196.

Alternative embodiments may include having seals between the first member and the third hollow body. Additional embodiments may also include incorporating the first member 192 as part of the third hollow body (e.g., reservoir end 182 of pipe nipple 180). Alternative embodiments may also include using the reservoir end 182 of the third hollow body as the biasing device 190 by extending a mesh, perforation, or configuration otherwise capable of fluid communication at the third hollow body's reservoir end 182. This could, for example, allow fluid communication between an overflow sump and a drop tube while biasing against the interstitial space seal.

The exemplary biasing device 190 is further shown with a second member 196 adapted to engage flange 152. The second member 196 can be similar in shape to the upper member 192 and, instead of having. threaded holes, the lower member 196 can include three recesses 197 of slightly larger diameter than the threaded holes. Again, a half circle bulge or tab 195 (also shown in FIG. 7) can be used to extend into the interior of the second member 196 if needed to facilitate a proper size and minimize the interference of the biasing device 190 with fluid flow, as will also be further discussed herein.

The biasing member of the biasing device 190 can comprise, for example, a screw or a combination of screws. In the depicted embodiment, and as best illustrated in FIGS. 4, 5 and 7, biasing device 190 includes three screws 198. The screws 198 are threaded into the first member 192 and extend to the surface of the recesses 197 of the second member 196. By continuing to tighten the screws 198, the biasing device 190 applies force to, or biases, the pipe nipple 180 and flange 152. This force can be used, for example, to help seal the first seal member 156 between flange 152 and the riser's restrictor 130. One advantage associated with such an embodiment includes ensuring that vapor 113 (depicted in FIG. 6 as arrows) rising from the reservoir through the interstitial space 148 cannot substantially escape past first seal member 156, nor may vapor substantially pass by the second seal member 158. However, fuel fluid from the overflow sump can still flow through the nozzle 150, and on through drop tube 140 to the tank.

An alternative embodiment of the biasing member may include a single screw, requiring only one threaded bore 194 in the first member 192 and one recess 197 in the second member 196. In such an embodiment, the tabbed portion of the first and second members, 192 and 196 respectively, may need to be larger to place the screw 198 in the middle of the fluid flow path in order to equalize the force on the interstitial space seal. Alternatively, an oppositely disposed sliding guide might be used to keep the biasing member from cocking if the adjustment screw was located adjacent the first and second member's outer edge. In further embodiments utilizing screws, one or more screws may be arranged in a variety of designs and combinations.

According to one embodiment, it might be desirable to design the biasing device in such a way as to maximize the inner diameter of the first and second members, 192 and 196 respectively, and minimize the size of any tabbed or bulged portions (such as depicted in FIG. 7 as tab 195) to minimize the interference with fluid flow. In another alternative embodiment of the current invention, flange 152 and/or nozzle 150 may be eliminated. For example, the second member 196 of the biasing device 190 could be placed in direct contact with first seal member 156. Further, the drop tube 140 and flange 152 could alternatively comprise one integral piece, thereby incorporating or eliminating nozzle 150.

Figure 8:
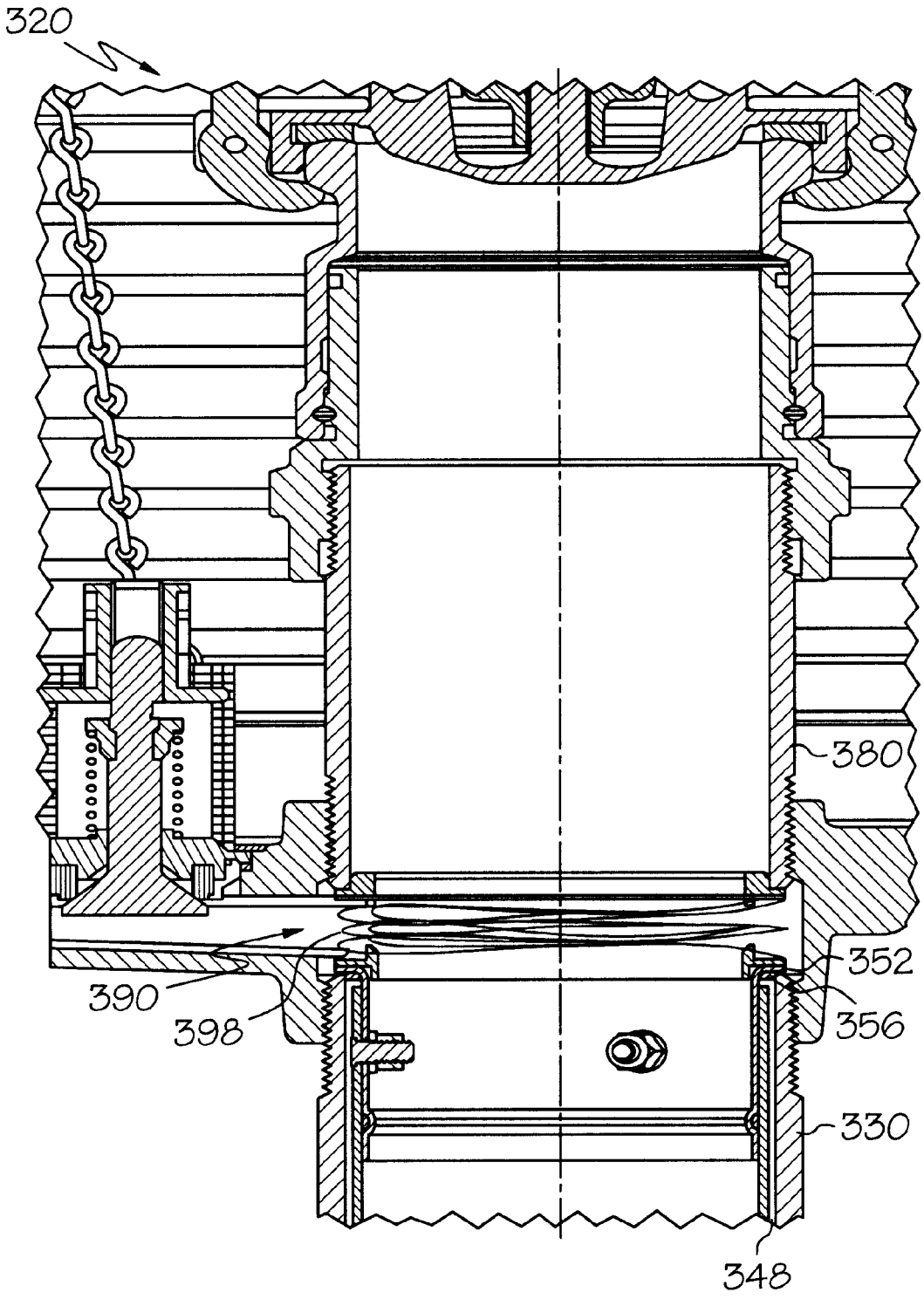
FIG. 8 is a partial cross sectional view of another embodiment of the fuel fluid communication assembly of the present invention.

Referring now to FIG. 8, in another alternative embodiment of the fuel fluid communication assembly 320, the biasing member and/or biasing device 390 could include a spring (e.g., 398). The spring 398, for example, could be used to bias the pipe nipple 380 with respect to the flange 352. The force thus exerted could help seal the first seal member 356 between the flange 352 and the riser 330, thus containing any vapor within the reservoir and the interstitial space 348.

Figure 9:
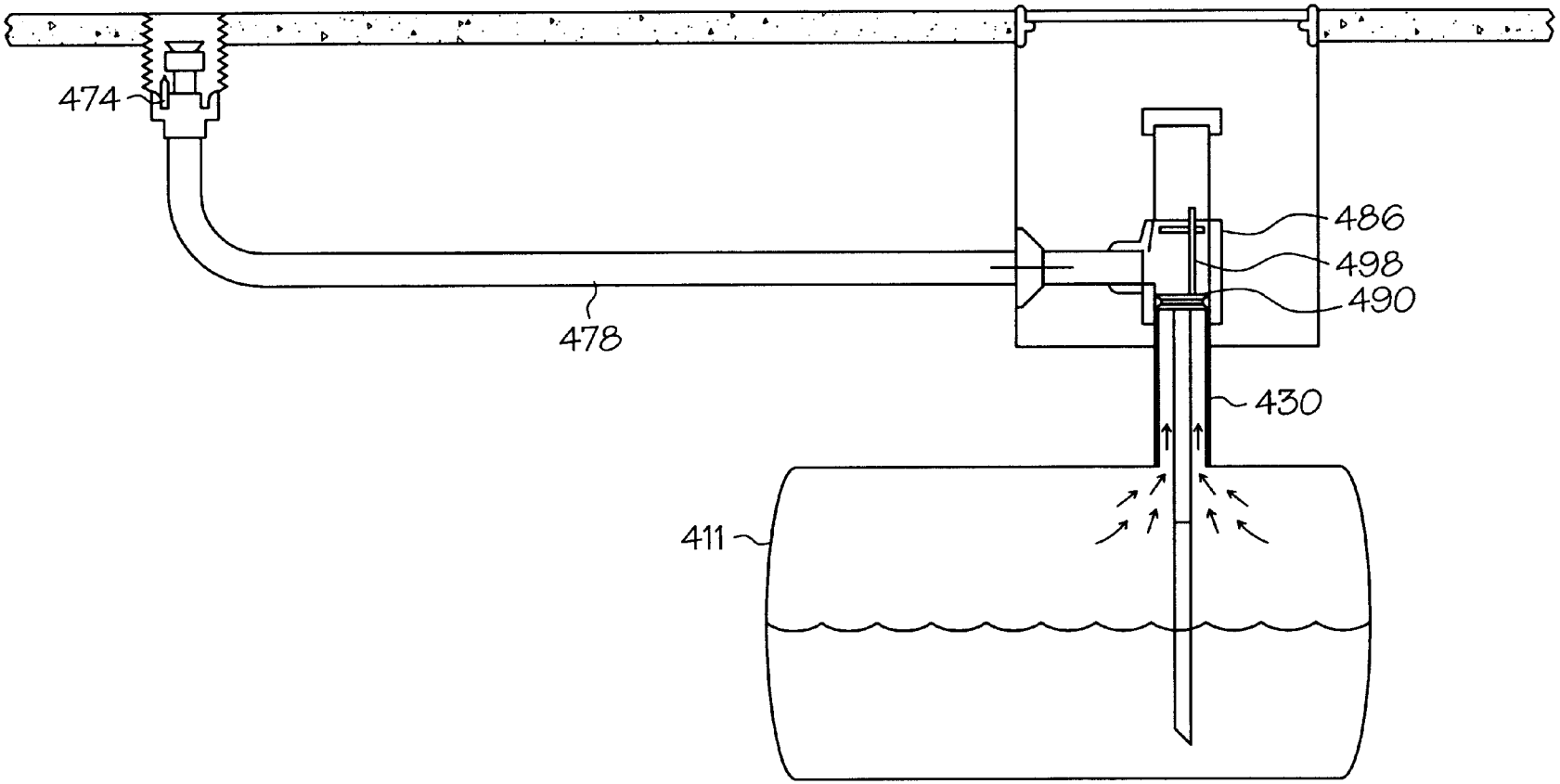
FIG. 9 is a schematic view of an embodiment of a fuel fluid communication assembly, as illustrated with a tank.

FIG. 9 depicts another embodiment of the current invention, wherein a tank 411 may be remotely filled. In this arrangement, drain valve 474 would drain similarly into extension pipe 478. Extension pipe 478 is connected to riser 430 by pipe tee 486 which performs similar functions to the riser adaptor from previous embodiments. However, where the riser adaptor is configured to receive a relatively small quantity of fluid from the overflow sump, the pipe tee 486 must additionally be large enough to receive all of the fluid during the filling process. Thus, the biasing device 490 may need longer screws 498 to allow for the increased volume of fluid passing through the biasing device 490.

Having described some of the embodiments of the fuel fluid communication assembly, a method of converting or retrofitting a conventional fuel fluid communication assembly, such as that shown in FIG. 3, will now be discussed. For example, to convert such an assembly to be in accordance with the current invention, a interstitial space seal, as might be made in various embodiments as previously discussed, may be added.

Referring to FIG. 3, to add such a interstitial space seal, the cap 24, lid 26, spill container 70, and pipe nipple 80 may be removed. (A newly manufactured assembly would not be assembled so this step would be skipped.) Next, the restrictor ends of the drop tube 40 and the riser pipe 30 should be substantially aligned. Typically, the drop tube 40 will need to be cut to size it appropriately with the riser pipe 30.

Referring now to FIG. 4, a flange may next be added to the drop tube 140 to allow the drop tube to seat or rest on the top of restrictor end 138 of the riser pipe 130. Alternatively, and if not already so configured, flange 152 may have, or be part of, a nozzle 150 connected to the drop tube 140. As discussed previously, in one embodiment, the height of the drop tube 140 can be between the height of the nozzle channel 153 and the restrictor end 138 of riser pipe 130. A first sealing member 156 can be inserted between flange 152 and the riser pipe 130 to seal the interstitial space 148.

Next, a biasing device, such as a bias device 190, may be added such that it will be between flange 152 and the pipe nipple 180 when installed. For example, if the biasing device 190 comprises screws 198, the screws 198 can be tightened such that the force necessary to seal interstitial space 148 is exerted. In another embodiment, if the biasing device includes a biasing member that is a spring 198, by attaching and tightening the pipe nipple 180, the spring will be compressed and help to seal the interstitial space 148. Finally, the pipe nipple 180, spill container 170, lid 124, and cap 126, should be reattached (if not already done).

Having shown and described the preferred embodiments of the present invention, further adaptations of the fuel fluid communication assembly and method of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the inventive system and process have been discussed for illustrative purposes, it should be understood that the elements described will be constantly updated and improved by technology advances. Accordingly, the scope of the present invention should be considered in terms of the following claims and is understood not to be limited to the details of structure, operation of process as shown, and described in the specification and drawings.

We claim:

1. A fuel fluid communication assembly for a fuel reservoir, the assembly comprising:

a) a spill restrictor;

b) a first hollow body attached to the restrictor and having an inwardly facing surface, a restrictor end and a reservoir end; and c) a second hollow body having an outwardly facing surface, the second hollow body received telescopingly within at least the reservoir end of the first hollow body, wherein the inwardly facing surface of the first hollow body and the outwardly facing surface of the second hollow body define an interstitial space; and d) an interstitial space seal.

2. The fuel fluid communication assembly of claim 1, wherein the interstitial space has a restrictor end for distal placement from the reservoir, and the interstitial space seal is located adjacent to the restrictor end of the interstitial space.

3. The fuel fluid communication assembly of claim 1, wherein the interstitial space seal comprises a seal member between the inwardly facing surface of the first hollow body and the outwardly facing surface of the second hollow body.

4. The fuel fluid communication assembly of claim 1, further comprising a third hollow body at least partially disposed in an interior space of the spill restrictor and in fluid communication with the second hollow body.

5. The fuel fluid communication assembly of claim 1, further comprising a flange configured to cooperate with the first and second hollow bodies to substantially seal the interstitial space with respect to the interior space of the spill restrictor.

6. The fuel fluid communication assembly of claim 5, wherein the interstitial space seal comprises a first seal member between an inwardly facing surface of the second hollow body and the flange, and a second seal member between the first hollow body and the flange.

7. The fuel fluid communication assembly of claim 5, wherein the flange is removably connected to the second hollow body.

8. The fuel fluid communication assembly of claim 1, further comprising a drain valve configured to provide selective fluid communication between the interior space of the spill restrictor and the second hollow body.

9. The fuel fluid communication assembly of claim 1, wherein the spill restrictor is provided with a base at the lower end of the spill restrictor, the base further comprising a sump extending from an entry end to an exit end, wherein fluid from the spill restrictor may drain into the entry end and then out through the exit end to an interior of the second hollow body.

10. The fuel fluid communication assembly of claim 9, wherein the interstitial space seal is located below the exit end of the sump.

11. The fuel fluid communication assembly of claim 10, wherein the interstitial space has a restrictor end distal from the reservoir, and the interstitial space seal is located adjacent to the restrictor end of the interstitial space.

12. The fuel fluid communication assembly of claim 10, wherein the interstitial space seal comprises a seal member between the inwardly facing surface of the first hollow body and the outwardly facing surface of the second hollow body.

13. The fuel fluid communication assembly of claim 10, further comprising a third hollow body at least partially disposed in an interior space of the spill restrictor and in fluid communication with the second hollow body.

14. The fuel fluid communication assembly of claim 10, further comprising a flange configured to cooperate with the first and second hollow bodies to substantially seal the interstitial space with respect to the interior space of the spill restrictor.

15. The fuel fluid communication assembly of claim 14, wherein the interstitial space seal comprises a first seal member between an inwardly facing surface of the second hollow body and the flange, and a second seal member between the first hollow body and the flange.

16. The fuel fluid communication assembly of claim 14, wherein the flange is removably connected to the second hollow body.

17. The fuel fluid communication assembly of claim 10, further comprising a drain valve configured to provide selective fluid communication between the interior space of the spill restrictor and the second hollow body.

18. The fuel fluid communication assembly of claim 10, further comprising a biasing device configured to provide a sealing force to the interstitial space seal.

19. The fuel fluid communication assembly of claim 18, wherein the biasing device comprises:

a) a first member;

b) a second member adapted to cooperate with the interstitial space seal; and c) a biasing member disposed between the first and second members.

20. The fuel fluid communication assembly of claim 19, wherein the biasing member comprises a screw.

21. The fuel fluid communication assembly of claim 20, wherein the screw is threaded into one of the first and second members of the biasing device and seats against the other respective member of the biasing device.

22. The fuel fluid communication assembly of claim 19, wherein the biasing member comprises a spring.

23. A fuel fluid communication assembly for a fuel reservoir, the assembly comprising:

a) a spill restrictor having an interior space;

b) a first hollow body attached to the restrictor and having an inwardly facing surface, a restrictor end and a reservoir end; and c) a second hollow body having an outwardly facing surface, the second hollow body received telescopingly within at least the reservoir end of the first hollow body, wherein the inwardly facing surface of the first hollow body and the outwardly facing surface of the second hollow body define an interstitial space;

d) an interstitial space seal; and e) a biasing device configured to provide a sealing force to the interstitial space seal to substantially seal the interstitial space with respect to the interior space of the spill restrictor.

24. The fuel fluid communication assembly of claim 23, wherein the biasing device comprises:

a) a first member;

b) a second member adapted to cooperate with the interstitial space seal; and c) a biasing member disposed between the first and second members.

25. The fuel fluid communication assembly of claim 24, wherein the biasing member comprises a screw.

26. The fuel fluid communication assembly of claim 25, wherein the screw is threaded into one of the first and second members of the biasing device and seats against the other respective member of the biasing device.

27. The fuel fluid communication assembly of claim 24, wherein the biasing member comprises a spring.

28. The fuel fluid communication assembly of claim 24, further comprising a flange adjacent the restrictor end of the first hollow body.

29. The fuel fluid communication assembly of claim 28, wherein the flange further comprises a nozzle having a portion extending into the second hollow body.

30. The fuel fluid communication assembly of claim 28, wherein the interstitial space seal comprises a first seal member between the second hollow body and the nozzle, and a second seal member between the first hollow body and the flange.

31. A method of providing a fuel fluid communication assembly featuring a selectively sealed interstitial space between a first hollow body and a second hollow body comprising the steps of:

a) substantially aligning the second hollow body with the first hollow body;

b) providing an interstitial space seal between the first and second hollow body; and c) attaching a spill restrictor to the first hollow body.

32. The method of claim 31, further comprising the step of adding a flange to an end of the second hollow body.

33. The method of claim 31, further comprising the step of providing a biasing device configured to provide a sealing force to an interstitial space seal to substantially seal the interstitial space with respect to the interior space of the spill restrictor.

34. The method of claim 33, further comprising the step of adjusting the biasing device to substantially seal the interstitial space with respect an interior space of the spill restrictor.

35. The method of claim 31, further comprising the step of removing a preexisting spill restrictor.

36. The method of claim 31, further comprising the steps of providing the spill restrictor a base at the lower end of the spill restrictor, and providing the base with a sump extending from an entry end to an exit end, wherein fluid from the spill restrictor may drain into the entry end and then out through the exit end to an interior of the second hollow body.

37. The method of claim 36, wherein the step of providing an interstitial space seal includes locating the interstitial space seal below the exit end of the sump.

38. The method of claim 37, further comprising the step of adding a flange to an end of the second hollow body.

39. The method of claim 37, further comprising the step of providing a biasing device configured to provide a sealing force to the interstitial space seal to substantially seal the interstitial space with respect to the interior space of the spill restrictor.

40. The method of claim 39, further comprising the step of adjusting the biasing device to substantially seal the interstitial space with respect an interior space of the spill restrictor.

41. The method of claim 37, further comprising the step of removing a preexisting spill restrictor.

* * * * *